US008826776B2

(12) United States Patent
Junk

(10) Patent No.: US 8,826,776 B2
(45) Date of Patent: Sep. 9, 2014

(54) MULTIFUNCTIONAL HAND TOOL HAVING CONTINUITY TESTER

(75) Inventor: Robert W. Junk, Cincinnati, OH (US)

(73) Assignee: Robert Junk, Cincinnati, OH (US)

( * ) Notice: Subject to any disclaimer, the term of this patent is extended or adjusted under 35 U.S.C. 154(b) by 289 days.

(21) Appl. No.: 13/472,775

(22) Filed: May 16, 2012

(65) Prior Publication Data

US 2012/0222221 A1 Sep. 6, 2012

Related U.S. Application Data

(63) Continuation-in-part of application No. 12/335,182, filed on Dec. 15, 2008, now abandoned.

(60) Provisional application No. 61/014,976, filed on Dec. 19, 2007.

(51) Int. Cl.
*B25F 1/00* (2006.01)

(52) U.S. Cl.
USPC ..... 81/52; 81/124.4; 7/138

(58) Field of Classification Search
USPC ..... 81/52, 121.1, 124.4, 124.7, 125.1; 7/107, 138, 164; 324/72.5
See application file for complete search history.

(56) References Cited

U.S. PATENT DOCUMENTS

| | | | | |
|---|---|---|---|---|
| 506,832 | A * | 10/1893 | Schofield | 7/138 |
| 842,039 | A * | 1/1907 | Brooke | 81/62 |
| 4,027,236 | A * | 5/1977 | Stewart | 324/556 |
| 6,848,139 | B2 * | 2/2005 | Simon et al. | 7/127 |
| 6,886,432 | B2 * | 5/2005 | Urban et al. | 81/437 |
| 7,073,918 | B1 * | 7/2006 | Bauman | 362/119 |
| 7,114,825 | B1 * | 10/2006 | Bauman | 362/119 |
| 7,302,753 | B2 * | 12/2007 | Cahill et al. | 29/721 |
| 7,355,377 | B1 * | 4/2008 | Gallentine | 324/72.5 |
| 7,468,674 | B2 * | 12/2008 | Onachilla et al. | 340/660 |
| 7,816,925 | B1 * | 10/2010 | Gale | 324/555 |
| 7,948,227 | B2 * | 5/2011 | Beckmann | 324/72.5 |
| 2009/0013477 | A1 * | 1/2009 | Agronin et al. | 7/107 |

* cited by examiner

*Primary Examiner* — David B Thomas

(57) ABSTRACT

The present invention is a multipurpose hand tool. The hand tool includes a substantially planar body, a continuity tester, and at least one triple-stacked socket wrench. The continuity tester has a single test lead connected to an indicator means connected to a power means connected to the substantially planar body.

19 Claims, 5 Drawing Sheets

MULTIFUNCTIONAL HAND TOOL HAVING CONTINUITY TESTER

CROSS-REFERENCE TO RELATED APPLICATION

The present application is a continuation-in part of U.S. patent application Ser. No. 12/335,182 filed Dec. 15, 2008, which claims the benefit of U.S. Patent Application No. 61/014,976 as filed Dec. 19, 2007.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to handheld tools, and more particularly to handheld tools for conducting a multitude of activities in construction and lighting industries.

2. Description of the Related Art

Electrical testing probes, also known as continuity testers, are used to determine whether or not an electrical path in a circuit or electrical connector is substantially unbroken. This is typically done by attaching one end of the probe to a first lead of the circuit or electrical connector to be tested and touching the other end of the probe to a second lead of the circuit or electrical connector to be tested. A small incandescent light bulb may be electrically connected between the two ends of the probe. If the circuit is substantially unbroken, then current flows through the bulb and the bulb lights. There are large numbers of these types of probes in existence; mainly for use in automotive and other electrical system testing. Obviously, they are very limited in the testing functions that they can perform.

Most available continuity testers are typically expensive, bulky, and easily broken. Further, especially in field of electrical lighting, most continuity testers are plug-specific. That is, each type of light system to be checked may require its own type of continuity tester.

The bulk and easily-breakable aspects of most continuity testers does not lend itself well to professional lighting professionals, especially those in the entertainment industry. In the entertainment industry, professionals have to position lighting systems in conspicuous locations so as to properly and dramatically light one or more stages. In order to conspicuously position the lighting systems, the lighting systems are most often hung high above an audience and/or stage; positioned in tight passages surrounding a stage, etc.

Positioning the lighting systems in such locations may be awkward at best. Individuals may be several stories above a stage or in a narrow crawl space in order to properly position the lighting systems. Positioning the lighting systems requires testing of the electrical continuity, which requires the use of a continuity tester.

As noted above, most continuity testers are bulky and plug specific. Thus, an individual may have to haul several continuity testers high above a stage. All the while the individual must be extremely careful not to drop the continuity tester which could severely injure another individual below and surely destroy the continuity tester itself.

Furthermore, most lighting professionals require additional tools for adjusting the position of the lighting systems. For example, wrenches, levers, etc., may be used to properly position and direct the lighting system. However, as not all lighting systems are standardized in parts, an individual may need to bring several sizes of each tool, that is, for example, several sizes of socket wrenches.

Thus, what is desired is an effective and compact device for testing the continuity of lighting systems as well as adjusting the position of the same.

SUMMARY

The exemplary embodiments of the present invention include a multipurpose hand tool. The hand tool is comprised of a substantially planar body, a continuity tester, and at least one triple-stacked socket wrench. The substantially planar body has a top-side, bottom-side, left-side, and right-side. The continuity tester consists of a test lead connected to an indicator means connected to a power means connected to the substantially planar body.

Other exemplary embodiments of the present invention also include a multipurpose hand tool. Such exemplary hand tools are comprised of a substantially planar body, a continuity tester, at least one triple-stacked socket wrench, a pair of slots, a first yoke bolt socket and a second yoke bolt socket, a long slot, and a c-clamp swivel nut socket. The substantially planar body has a top-side, bottom-side, left-side, and right-side. The continuity tester consists of a test lead connected to an indicator means connected to a power means connected to the substantially planar body. The pair of slots includes one on the right-side of the substantially planar body and one on the left-side of the substantially planar body. The second yoke bolt socket is of a different size than the first yoke bolt socket.

Other exemplary embodiments of the present invention also include a multipurpose hand tool. Such exemplary hand tools are comprised of a substantially planar body, a continuity tester, at least one triple-stacked socket wrench, a pair of slots, a first yoke bolt socket and a second yoke bolt socket, a long slot, and a c-clamp swivel nut socket. The substantially planar body has a top-side, bottom-side, left-side, and right-side. The continuity tester consists of a test lead connected to an indicator means connected to a power means connected to the substantially planar body. The triple-stacked socket wrench has at least one socket that is ratcheting. The pair of slots includes one on the right-side of the substantially planar body and one on the left-side of the substantially planar body. The second yoke bolt socket is of a different size than the first yoke bolt socket.

BRIEF DESCRIPTION OF THE DRAWINGS

The various exemplary embodiments of the present invention, which will become more apparent as the description proceeds, are described in the following detailed description in conjunction with the accompanying drawings, in which.

DESCRIPTION OF THE REFERENCED NUMERALS

Figure 1:
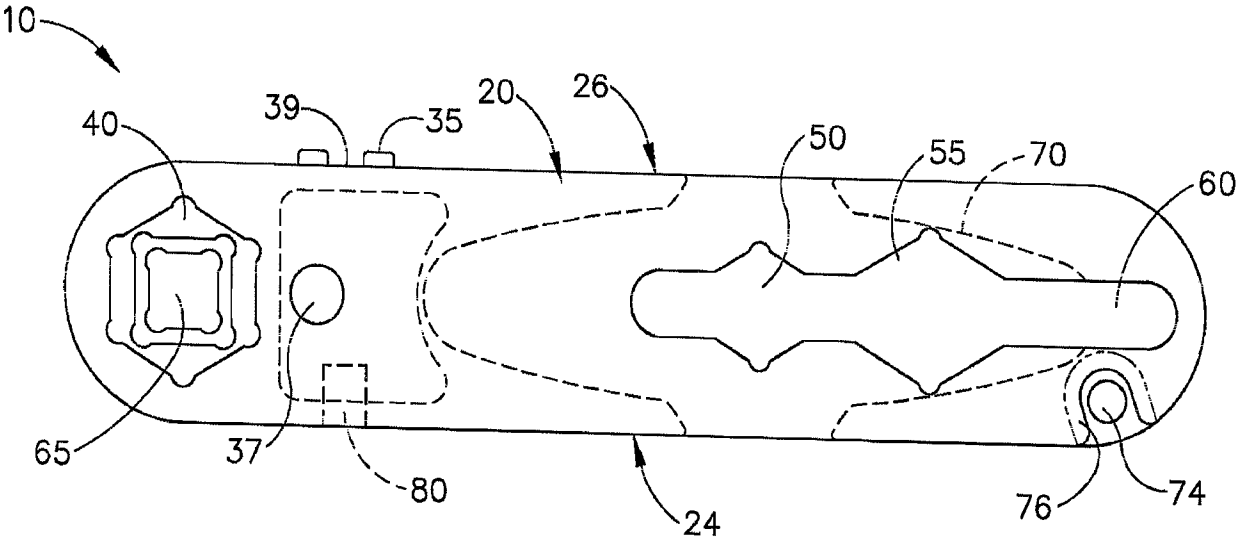
FIG. 1 is a top-side perspective view of an embodiment of the present invention.

In reference to the drawings, similar reference characters denote similar elements throughout all the drawings. The following is a list of the reference characters and associated element:

10 multifunctional hand tool
20 top-side
22 bottom-side
24 left-side
26 right-side
35 guard
37 indicator means
38 power means
39 test lead
40 triple-stacked socket wrench
42 ratcheting means
45 slot
50 first yoke bolt socket
55 second yoke bolt socket
60 long slot
65 c-clamp swivel nut socket
70 handle slot
74 lanyard hole
76 bottle opener
80 pin splitter

DETAILED DESCRIPTION

FIGS. 1-4 illustrate exemplary embodiments of a multifunctional hand tool 10 according to the present invention.

The multifunctional hand tool is comprised of a substantially planar body having a top-side 20, a bottom-side 22, a left-side 24, and a right-side 26.

In a preferred embodiment, the multifunctional hand tool is comprised of a metal, an alloy, or another electric-conducting material. In a more preferred embodiment, the multifunctional hand tool is comprised of aluminum, preferably with a hard coat anodization.

The multifunctional hand tool includes a continuity tester. The continuity tester consists of an indicator means 37 arranged in series with a power means and a single test lead 39, and the indicator means is shielded by a guard 35 on each side. In exemplary embodiments the indicator means is a light emitting diode (LED). In other exemplary embodiments, the indicator means may be an auditory signal. The power means of the exemplary embodiments may be a battery.

Typically, continuity testers consist of two test leads. However, in the exemplary embodiments of the present invention, the test lead is connected to the indicator means which is further connected to the power means. The power means is then connected to the substantially planar body of the multifunctional hand tool. As such, when testing an electrical power source, one lead of the electrical device to be tested is positioned against the test lead of the present invention and a second lead of the electrical device to be tested is positioned to be adjacent to any portion of the substantially planar body of the present invention. As the substantially planar body conducts electricity, the indictor means is activated because a complete circuit is created between the electrical device to be tested, the test lead, indictor means, battery, and substantially planar body. If the electrical device to be tested fails, that is, the electrical circuit within the electrical device to be tested is not complete or substantially complete, a complete circuit is not made and the indicator means is not activated.

Therefore, in the exemplary embodiments wherein the indicator means is a LED, if the electrical device to be tested is positioned to test leads against the test lead and the substantially planar body, the LED will turn on if a complete circuit is made thereby indicating that the electrical device to be tested passes. If the electrical device fails under the same above arrangement, the LED will remain unlit.

According to exemplary embodiments of the present invention, there may also be a pin splitter 80 for testing about 20 to about 60 amp bates connectors. The pin splitter is accessible on the side opposite of the test lead of the substantially planar device. In the exemplary embodiments shown in FIGS. 2 and 4, the pin splitter is on the right side, but other exemplary embodiments may have a different arrangement.

In various exemplary embodiments, the multifunctional hand tool 10 is further comprised of at least one triple-stacked socket wrench 40. The at least one triple-stacked socket wrench substantially fits around a bolt of a typical c-clamp and star knob often utilized in the lighting industry. C-clamps are often used to position and hold lighting systems on light bars. In the exemplary embodiments illustrated in FIGS. 1 and 3, the triple-stacked socket wrench is formed into the top-side of the substantially planar body. However, other embodiments may include an arrangement such that the triple-stacked socket wrench is formed into the bottom-side of the substantially planar body.

Figure 2:
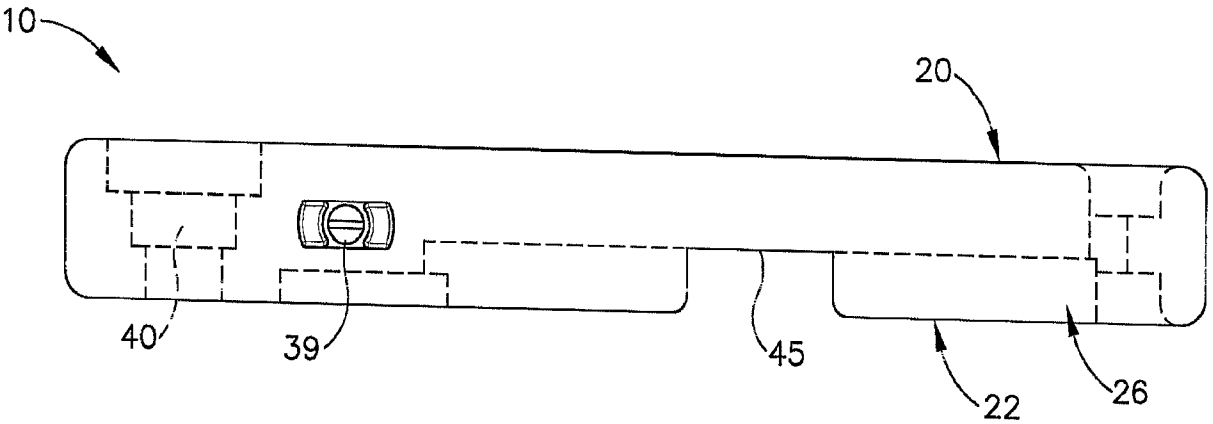
FIG. 2 is a cross-sectional, right-side perspective view of an embodiment of the present invention.

The triple-stacked socket wrench is comprised of three different sizes of sockets. In the embodiments illustrated in FIGS. 1 and 3, the socket of the triple-stack socket wrench that is closest to the top-side of the substantially planar body is the largest of the three sockets. The smallest is the socket of the triple-stack socket wrench that is closest to the bottom-side of the substantially planar body. However, other embodiments may include an arrangement such that the largest of the triple-stacked sockets is closest to the bottom-side of the substantially planar body, and the smallest is closest to the top-side of the substantially planar body. FIG. 2 displays a right-side perspective view of the different sizes of sockets as in the exemplary embodiment illustrated in FIG. 1.

The actual size of each socket of the triple-stack socket wrench may vary as desired; however, the largest of the three sockets should be open on one side of the substantially planar body and the remaining sockets of the triple-stacked socket wrench should be respectively smaller. The sockets may be standard, metric, or a combination thereof.

Figure 3:
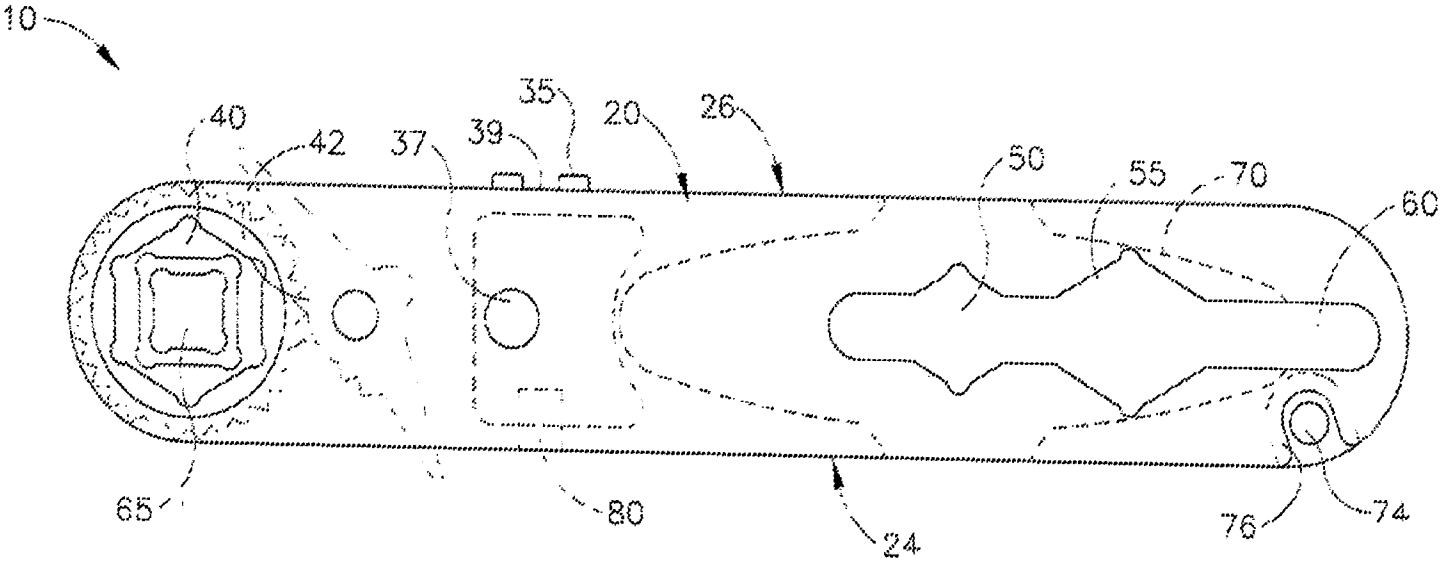
FIG. 3 is a top-side perspective view of an embodiment of the present invention.
Figure 4:
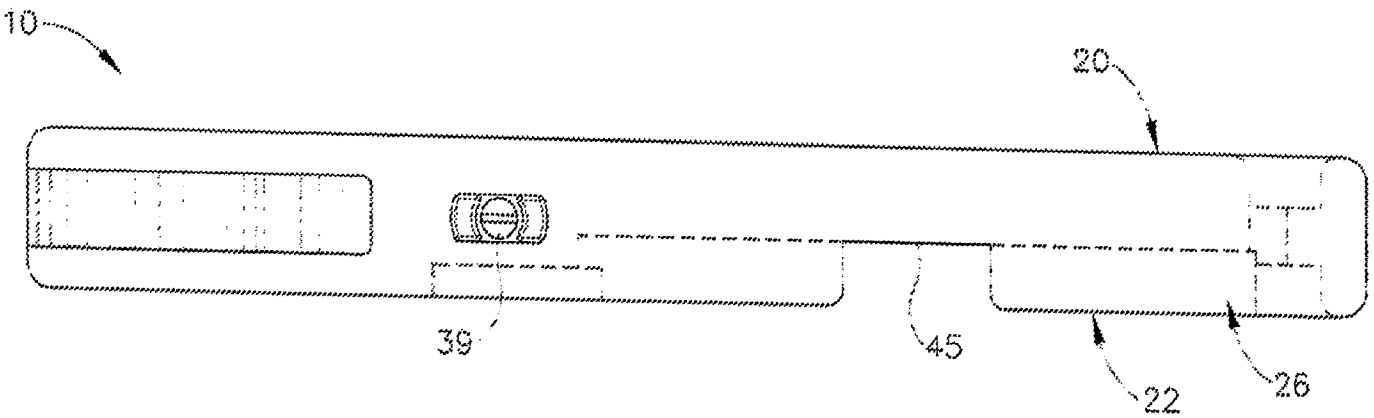
FIG. 4 is a right-side perspective view of an embodiment of the present invention.

Further, each of the sockets of the triple-stacked socket wrench may be ratcheted to allow a respective nut or bolt to be tightened or loosed in a substantially continuous motion, rather than requiring the triple-stack socket wrench to be removed from the nut or both and then refitted after each turn. FIG. 3 shows an exemplary embodiment of the present invention that includes a ratcheting means 42. Exemplary embodiments of a ratcheting means may include a ratchet and pawl, among other type of ratchets, and may also include a means for locking.

A pair of slots 45 may be formed on opposites of the substantially planar body. The pair of slots represented from a side-view perspective in FIGS. 2 and 4 and in dotted lines in FIGS. 1 and 3 are on the right-side and left-side of the substantially planar body. The pair of slots may be used to grip against and turn wing nuts, road case handles, Mac 500 cam thumb screws, shackle bolts, and the like. Thus, the pair of slots may serve as a quasi-wrench.

A first yoke bolt socket 50 is illustrated in the exemplary embodiments in FIGS. 1 and 3. The first yoke bolt socket may substantially surround a yoke bolt such that the yoke bolt may more easily be tightened or loosened. The first yoke bolt socket may be of any size. In a preferred embodiment, it fits around a half inch yoke bolt.

In various exemplary embodiments as those in FIGS. 1 and 3, there is a second yoke bolt socket 55. The second yoke bolt socket is preferably of a different size than the first yoke bolt socket.

In a preferred embodiment, both the first yoke bolt socket and the second yoke bolt socket are on the top-side of the substantially planar body. That is, each of the first yoke bolt socket and the second yoke bolt socket are open to the top-side of the substantially planar body.

A long slot 60 may be present as well to substantially fit around wing nuts, road case latches, and thumbs screws. The long slot may be open to the top-side as illustrated in the drawings, and connect both the first yoke bolt socket and the second yoke bolt socket.

The multifunctional hand tool may also include a c-clamp swivel nut socket 65. The c-clamp swivel nut socket illustrated opens to the smallest socket of the triple-stacked socket. The actual size of the c-clamp swivel nut socket may vary. In a preferred embodiment, the c-clamp swivel nut socket substantially fits a quarter inch c-clamp swivel nut.

There may also be a handle slot 70 that substantially fits microphone stands. As illustrated, the handle slot is substantially oval-shaped and open to the bottom-side of the substantially planar body.

The substantially planar body may also have a lanyard hole 74 and bottle opener 76.

Figure 5:
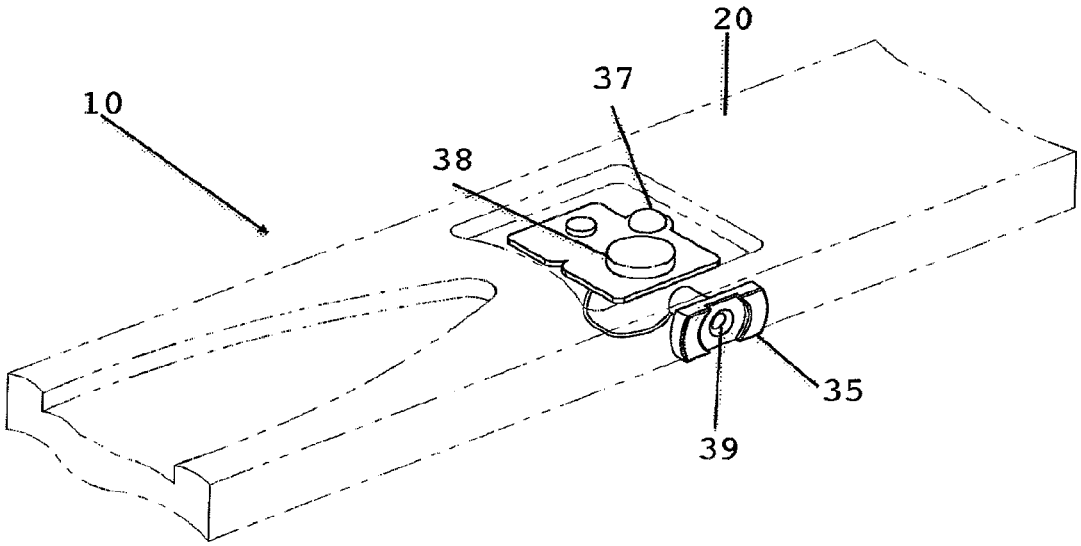
FIG. 5 is a perspective view of an example continuity tester in accordance with one or more embodiments.

FIG. 5 illustrates an example embodiment of a continuity tester in accordance with one or more embodiments. In particular, the multifunctional hand tool 10 in FIG. 5 includes an indicator means 37, which can be, for example, an LED. Also included is a power means 38, which in various embodiments, is a battery. The continuity tester also includes a test lead 39, located on the side of the multifunctional hand tool 10. A guard 35 surrounds the test lead 39, and reduces the likelihood that the continuity tester will be activated while in a user's pocket or upon accidentally completing a circuit, such as when left on a metal surface.

Figure 6:
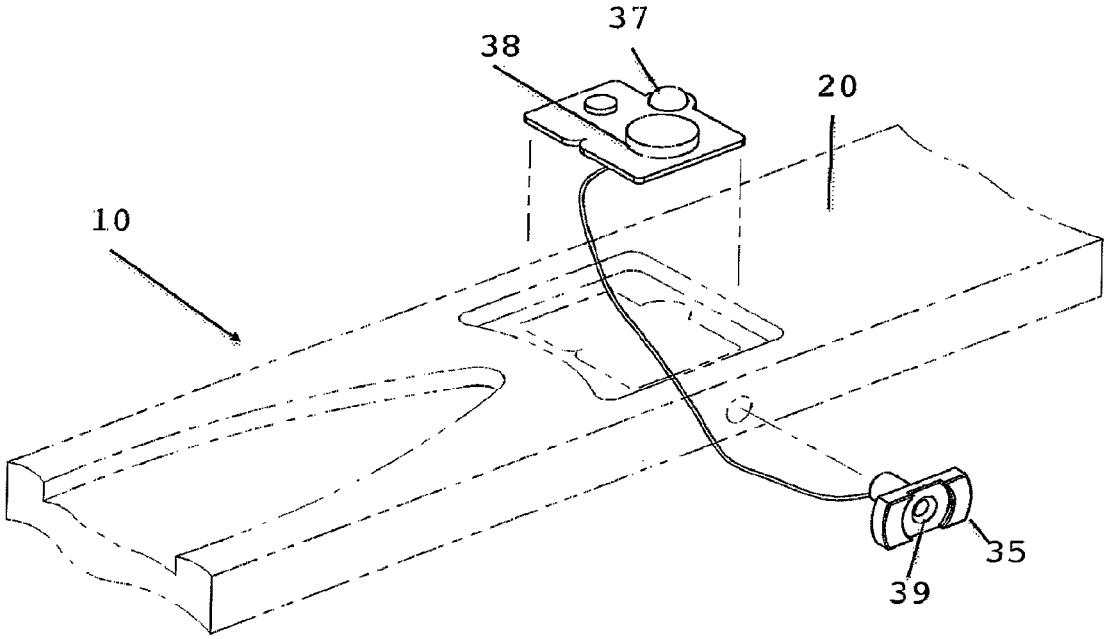
FIG. 6 is an exploded view of an example continuity tester in accordance with one or more embodiments.

FIG. 6 illustrates an exploded view of the example embodiment depicted in FIG. 5. As shown in FIG. 6, a guard 35 surrounds test lead 39. The test lead 39 is connected via a wire to power means 38. The power means 38 and the indicator means 37 are also electrically coupled. In particular, the power means 38 and the indicator means 37 are co-located within the substantially planar body, which is made of an electrically conductive material. When an electrical device, such as a plug, is to be tested, one lead (e.g., prong) of the device is positioned against test lead 39 and another lead of the device is positioned against the side of the multifunctional hand tool 10. The indicator means 37 is activated when a complete circuit is completed between the electrical device being tested, the test lead 39, the indicator means 37, the power means 38 and substantially planar body.

Figure 7:
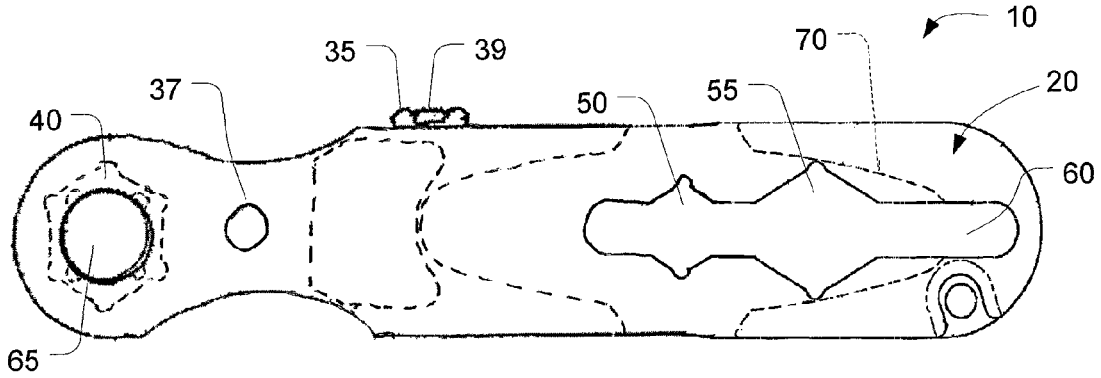
FIG. 7 is a perspective view of an alternative embodiment of the present invention.

FIG. 7 illustrates an alternate formation of a multifunctional hand tool 10 in accordance with various embodiments. In particular, the end of the tool including the triple-stacked socket wrench 40 and c-clamp swivel nut socket 65 has a rounded shape and is connected to the substantially planar body via a neck area. Taken together, FIGS. 1-7 illustrate various example shapes which a multifunctional hand tool 10 can take in accordance with one or more embodiment, although it is to be understood that the multifunctional hand tool 10 can take other shapes and include other tools and features.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A multipurpose hand tool, the tool being comprised of:
a substantially planar body having a top-side and a bottom-side;
a continuity tester consisting of a single test lead connected to an indicator means connected to a power means connected to the substantially planar body; and
at least one triple-stacked socket wrench.

2. The multipurpose hand tool according to claim 1, wherein each socket of the triple-stacked socket wrench is each of a different respective size such that the largest socket is closest to an outside of the substantially planar body.

3. The multipurpose hand tool according to claim 1, wherein at least one socket of the triple-socket wrench is ratcheting.

4. The multipurpose hand tool according to claim 1, wherein the indicator means is a light emitting diode.

5. The multipurpose hand tool according to claim 1, wherein the indicator means is an auditory signal.

6. The multipurpose hand tool according to claim 1, wherein the power means is a battery.

7. The multipurpose hand tool according to claim 1, further comprising a pair of slots, one on a right-side of the substantially planar body and one on a left-side of the substantially planar body.

8. The multipurpose hand tool according to claim 1, further comprising a first yoke bolt socket.

9. The multipurpose hand tool according to claim 8, further comprising a second yoke bolt socket, the second yoke bolt socket being of a different size than the first yoke bolt socket.

10. The multipurpose hand tool according to claim 1, further comprising a long slot.

11. The multipurpose hand tool according to claim 1, further comprising a c-clamp swivel nut socket.

12. The multipurpose hand tool according to claim 1, further comprising a lanyard hole.

13. The multipurpose hand tool according to claim 1, wherein the substantially planar body is comprised of a metal, alloy, or combination thereof.

14. The multipurpose hand tool according to claim 13, wherein the substantially planar body is comprised of aluminum.

15. The multipurpose hand tool according to claim 1, wherein the substantially planar body is hard coat anodized.

16. A multipurpose hand tool, the tool being comprised of:
a substantially planar body having a top-side, bottom-side, left-side, and right-side;
a continuity tester consisting of a single test lead connected to an indicator means connected to a power means connected to the substantially planar body;
at least one triple-stacked socket wrench;

a pair of slots, one on the right-side of the substantially planar body and one on the left-side of the substantially planar body;

a first yoke bolt socket;

a second yoke bolt socket, wherein the second yoke bolt socket is of a different size than the first yoke bolt socket;

a long slot; and a c-clamp swivel nut socket.

17. The multipurpose hand tool according to claim 16, wherein each socket of the triple-stacked socket wrench is each of a different respective size such that the largest socket is closest to an outside of the substantially planar body.

18. A multipurpose hand tool, the tool being comprised of:

a substantially planar body having a top-side, bottom-side, left-side, and right-side;

a continuity tester consisting of a single test lead connected to an indicator means connected to a power means connected to the substantially planar body;

at least one triple-stacked socket wrench wherein at least one socket of the triple-socket wrench is ratcheting;

a pair of slots, one on the right-side of the substantially planar body and one on the left-side of the substantially planar body;

a first yoke bolt socket;

a second yoke bolt socket, wherein the second yoke bolt socket is of a different size than the first yoke bolt socket;

a long slot; and a c-clamp swivel nut socket.

19. The multipurpose hand tool according to claim 18, wherein each socket of the triple-stacked socket wrench is each of a different respective size such that the largest socket is closest to an outside of the substantially planar body.

* * * * *